United States Patent [19]

Wallin et al.

[11] 4,030,312

[45] June 21, 1977

[54] HEAT PUMPS WITH SOLAR HEAT SOURCE

[75] Inventors: Mark Wallin, Philadelphia, Pa.; Aaron Shantzer, deceased, late of Bucks County, Pa., by Helen Shantzer, executrix

[73] Assignee: Shantzer-Wallin Corporation, Norristown, Pa.

[22] Filed: Apr. 7, 1976

[21] Appl. No.: 674,641

[52] U.S. Cl. ..... 62/2; 62/238; 62/324

[51] Int. Cl.[2] ..... F25B 27/00; F25B 27/02; F25B 13/00

[58] Field of Search ..... 62/238, 160, 324, 2, 62/79

[56] References Cited

UNITED STATES PATENTS

| | | | |
|---|---|---|---|
| 2,748,571 | 6/1956 | Henderson | 62/238 |
| 2,751,761 | 6/1956 | Borgerd | 62/238 |
| 3,188,829 | 6/1965 | Siewert et al. | 62/238 |
| 3,301,002 | 1/1967 | McGrath | 62/238 |
| 3,513,663 | 5/1970 | Martin, Jr. et al. | 62/238 |
| 3,916,638 | 11/1975 | Schmidt | 62/238 |
| 3,960,322 | 6/1976 | Ruff et al. | 62/2 |

*Primary Examiner*—Lloyd L. King

*Attorney, Agent, or Firm*—Daniel E. Kramer

[57] ABSTRACT

A reversible compression type refrigeration system is commonly known as a heat pump for conditioning a space having a conditioning side and a service side. The conditioning side is that area or environment where it is intended to achieve the benefit of the alternate heating and cooling effects produced by the reversible system. The service side is that side from which heat is drawn or to which heat is rejected when the opposite effect is required on the conditioned side. The system includes a conditioning coil connected to the conditioning side for absorbing heat from the space when cooling is required (cooling cycle) and rejecting heat to the space when heating is required (heating cycle); a first "service" coil connected to the service side adapted to reject heat to the outdoor air during system cooling cycles and absorb heat from the outdoor air on heating cycles; a second "service" coil connected to the service side adapted to withdraw direct or stored heat from a liquid stream heated by a solar collector, and reversible means to allow the first service coil to withdraw heat from the outside air under conditions where the supply of direct or stored solar heat intended to be delivered to the second service coil has been exhausted.

13 Claims, 6 Drawing Figures

HEAT PUMPS WITH SOLAR HEAT SOURCE

BACKGROUND OF THE INVENTION

1. Field of the Invention

The invention encompasses three fields:

First: The field of heat pumps; that is, mechanical refrigeration systems which are reversible; where the heat absorbing coil can become the heat rejecting coil and simultaneously where the heat rejecting coil can become the heat absorbing coil.

Second: The field related to the gathering and utilization of radiant solar energy.

Third: The combination of first and second fields where the absorbed and retained solar energy is used to supply heat at a relatively high temperature level to the cold side of the refrigeration system so that an adequate supply of heat can be delivered to the comfort zone at minimum power cost, by virtue of having utilized available solar energy.

2. Description of the Prior Art

Reversible refrigeration systems are well-known. Generally they employ a conditioning heat exchanger in a conditioned zone and a service heat exchanger exposed to a zone to which heat can be rejected when the conditioning heat exchanger is cooling, and from which heat can be absorbed when the conditioning heat exchanger is heating (outdoor zone). In a well-known heat pump design the service (outdoor) coil rejects its heat into ambient air of the outdoor zone during the cooling cycle and absorbs heat from the ambient air of the outdoor zone during the heating cycle. In water-side heat pumps waste heat is discharged to a water stream through a refrigerant-water heat exchanger (water-cooled condenser). During the heating cycle, heat is absorbed from that water stream. The heat depleted water discharged by the heat exchanger is generally reheated by some means or discarded, as in a once through system. During the cooling cycle, heat is rejected to the water stream, which may be discarded, although designs are known where on the cooling cycle the water is cooled for recycling by recirculation through a cooling tower, and during heating, the heat abstracted from the water is resupplied by one or more solar collectors.

SUMMARY OF THE INVENTION

The invention teaches a compression-type reversible refrigeration system having a heating cycle and a cooling cycle and including a heat exchanger in heat transfer relation to a conditioning side and two heat exchangers alternately connectable into heat transfer relation to a service side. A first service heat exchanger is adapted to exchange heat between refrigerant and outside air, acting as a condenser to discharge heat to the outside air during cooling cycles and as an evaporator, withdrawing heat from the outside air during certain portions of the heating cycles and a second heat exchanger adapted for heat exchange between refrigerant and water or brine; a solar collector for heating the brine; storage means for storing heat collected by the solar collector; means for circulating the brine between the collector and the storage means on one hand and between the storage means and the second heat exchanger on the other hand, and refrigerant controls which allow either the first or second heat exchangers to function on the heating cycle depending on whether solar heat is available or has been depleted. In one modification of the invention the heat exchangers are operative according to the following table:

HEAT EXCHANGERS IN USE

| Heat Pump Mode | Conditioning Side Heat Ex. | Service Side: Refrigerant to Air Heat Ex. | Service Side: Refrigerant to Brine Heat Ex. |
|---|---|---|---|
| Cooling Cycle | Evaporating (Cooling Conditioned Space) | Condensing (Rejecting heat to air) | Not used |
| Heating Cycle: Mode I | Condensing (Heating conditioned Space) | Not used | Evaporating (withdrawing heat from circulating brine) |
| Heating Cycle: Mode II | Condensing (Heating conditioned Space) | (Evaporating) withdrawing heat from circulating air | Not used |

My invention has the advantage of allowing heat pumps to operate at high efficiency during heating cycles by using direct or stored solar heat as a heat source. My invention causes the solar collector to operate at higher efficiencies by allowing the collector fluid to remain at lower temperatures and reduce heat loss to the ambient.

My invention allows the use of simplified and smaller solar collectors since the collector need not heat the fluid to as high a temperature as in the case that the fluid would be used to heat a conditioned space directly.

My invention combines the above advantages with the additional advantage of achieving dry or air cooled condensing during cooling cycles and the additional advantage of providing a free source of domestic hot water during cooling cycles.

My invention allows useful heat to be abstracted from the ambient air without reducing the temperature of the storage while simultaneously the solar heater raises the temperature and therefore the quantity of heat in the storage to a maximum.

DETAILED DESCRIPTION OF THE PREFERRED EMBODIMENT

Figure 1:
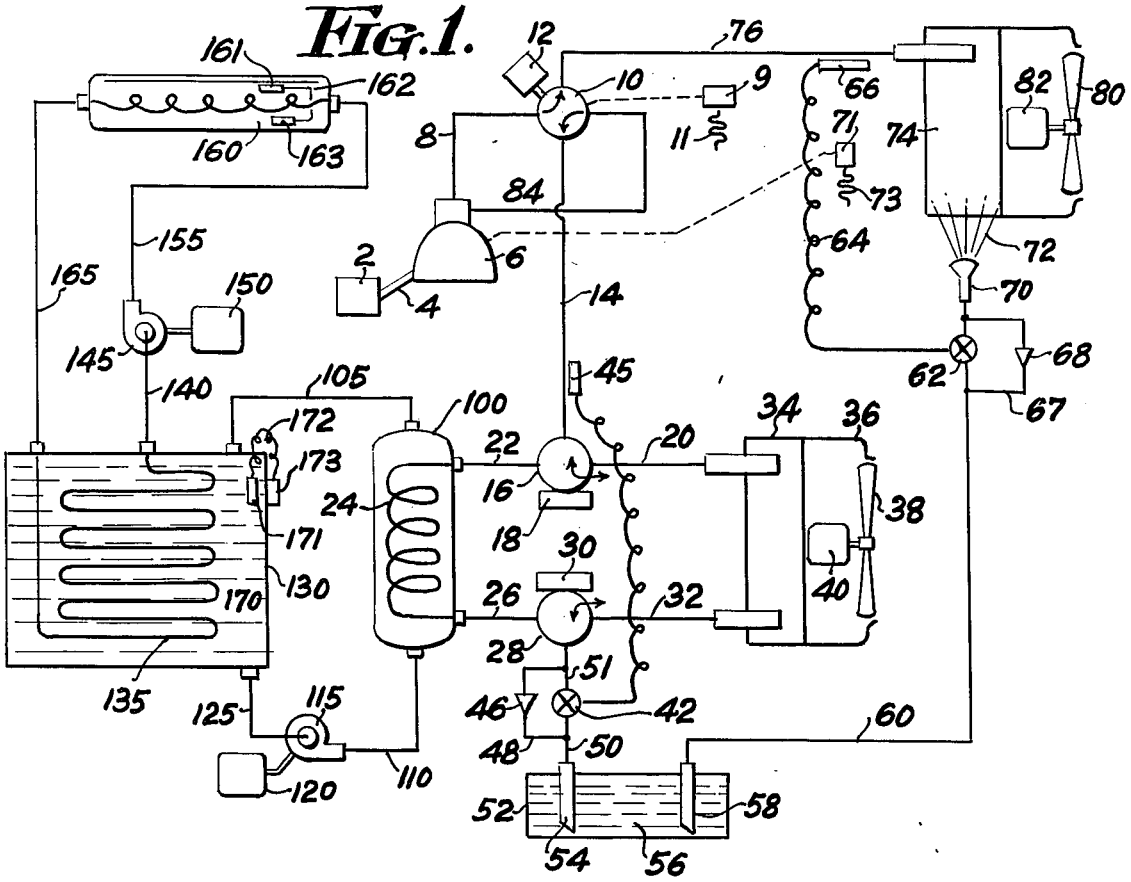
FIG. 1 is a schematic piping diagram showing a basic form of the invention including a heat pump system having a four-way reversing valve and a conditioning heat exchanger and two service heat exchangers: a first service heat exchanger for heat exchange with a forced air stream, and a second service heat exchanger for heat exchange with a forced water stream; two three-way valves for directing refrigerant flow alternately to the first and second service heat exchangers; a solar collector and a heat storage connected to the second heat exchanger and means for actuating the three way valves.

In FIG. 1 the refrigerant circuit of the reversible heat pump refrigeration system comprises compressor 6 driven by motor 2 through shaft 4. Compressor 6 discharges refrigerant vapor through its discharge line 8 into four-way valve 10, which is actuated by solenoid coil 12. On the cooling cycle, four-way valve 10 directs the discharge refrigerant stream from compressor discharge line 8 into conduit 14 which in turn enters three-way valve 16, actuated by solenoid coil 18 mounted on it. During the cooling cycle, this valve is disposed to direct discharge refrigerant vapor from conduit 14 into conduit 20 through which it flows into a first service heat exchanger which is finned heat transfer coil 34 over which air is forced by fan 38 driven by motor 40. The cooling air forced by fan 38 over the condenser coil 34 causes the hot refrigerant vapor traversing the condenser 34 to condense to a liquid. This condensed refrigerant liquid leaves the condenser via outlet pipe 32 and enters three-way valve 28 which is actuated by solenoid coil 30. Three-way valve 28 directs the refrigerant from conduit 32 into conduit 51, thence into conduit 48, which contains check valve 46. Conduit 48 with its included check valve is arranged to bypass expansion valve 42 and deliver the condensed liquid directly into dip tube 54 to receiver 52. The condensed refrigerant is collected in receiver 52 and retained therein until it is required. At that time it is withdrawn from the receiver 52 through dip tube 58 and conducted to the expansion valve 62 via liquid line 60. The liquid refrigerant cannot enter the conditioning heat exchanger 74 (indoor coil) directly since check valve 68, in the conduit which bypasses the expansion valve 62, is oriented in such a direction to prevent flow directly into the conditioning exchanger 74 but to allow flow in the reverse direction. Therefore the liquid refrigerant enters the conditioning exchanger 74 under the control of the expansion valve 62 which in turn is controlled by its thermal bulb 66 connected to the expansion valve by its small bore capillary tube 64. The liquid refrigerant enters the conditioning heat exchanger 74 through distributor 70 and distributor tube 72. In the conditioning heat exchanger 74 the refrigerant liquid is all evaporated to a vapor. The vapor leaves the evaporator via its suction manifold and enters suction line 76, to which thermostatic expansion valve bulb 66 is securely strapped in close thermal transfer relationship. The suction vapor from evaporator 74 returns to the compressor via conduit 76, four-way valve 10 and compressor suction conduit 84.

The operation of the compressor is controlled by a first thermostat, 71 having sensing element 73 which is subject to the temperature of the air which traverses conditioning exchanger 74 and serves to turn the compressor on to achieve cooling effect when the temperature is above the thermostat setting and to turn the compressor off when the temperature is at or below its setting.

The mode of four-way valve 10 is determined by the actuation or deactuation of its solenoid coil 12, which, in turn, is determined by a second thermostat 9 having sensing element 11 subject to the temperature of the conditioned space. When the temperature of this space is above the set point of this second thermostat, four-way solenoid coil 12 is energized, causing the mechanism of the valve 10 to shift in such a way as to cause the discharge vapor from conduit 8 to be directed into conduit 14 and the suction vapor of conduit 76 to be directed into compressor suction conduit 84, producing a cooling mode.

On this cooling mode, three-way valves 28 and 16 are both in their deenergized state and in this condition are constructed so that the vapor flow is from conduit 14 into conduit 20 to the inlet of the air cooled service heat exchanger and from service heat exchanger outlet conduit 32 to conduit 51, all as described above.

When heat is required in the conditioned space, the second thermostat causes four-way solenoid coil 12 to be deenergized. This causes the internal mechanism of valve 10 to shift so that discharge vapor from conduit 8 is directed into conduit 76 to the manifold of conditioning coil 74. Within this conditioning coil 74 the refrigerant vapor is condensed to a liquid, its heat being transferred to air forced over the conditioning coil 74 by fan 80. This fan, in turn, is powered by motor 82. The refrigerant, in condensing, delivers up its significant latent heat to the traversing air stream, warming it, and in so doing, achieving the desired effect of raising the temperature of the conditioned space. When the temperature of the conditioned space is raised to a level above the set point of the first thermostat which controls the operation of compressor 6, that thermostat turns off the power supply to motor 2, which causes compressor 6 to stop operating. While the compressor is operating, the condensed refrigerant vapor now leaves coil 74 via its distributor tubes 72 and distributor 70. Expansion valve 62 is closed, by virtue of the high pressure imposed on it by the compressor discharge pressure and the refrigerant liquid instead bypasses expansion valve 62, via conduit 67, in which is located check valve 68 and proceeds via conduit 60 to enter receiver 52 where it is held and stored until required. At that time, refrigerant liquid 56 leaves the receiver via dip tube 54 and is metered into either service evaporator 100 or service evaporator 34, depending on the positioning of the three-way valves 28 and 16. The positioning of these valves is determined by thermostat bulb 171, which is immersed in heat storage fluid 170 contained in storage tank 130. This thermostat bulb 171 communicates its temperature via its capillary tube 172 to thermostat switch mechanism 173 which functions at a preset temperature. Switch 173 on the heating cycle causes three-way solenoid coils 18 and 30 to be energized, directing flow to and from service heat exchanger 100 when heat storage fluid 170 is above the preset temperature indicating that an adequate amount of heat is stored therein for proper functioning in service coil 100. If there has been insufficient solar energy transferred to storage brine 170 by the solar collector 160, or if the amount of heat withdrawn from the storage brine 170 by the service heat exchanger 100 is in excess of the amount of heat delivered to it by the solar collector 160, then the temperature of brine 170 will be below the setting of thermostat 173 and thermostat 173 will act to deenergize three-way solenoid coils 18 and 30, causing the internal mechanism of three-way valves 16 and 28 to shift in such a way that the refrigerating effect of the system is transferred from refrigerant-brine service heat exchanger 100 to refrigerant-air heat exchanger 34. Switch 173 also acts to control motor 120 which drives pump 115.

The operation of the solar heat collection, heat storage and heat utilization system is as follows:

There are two brine circuits, the circuit traversing the solar collector (the solar circuit) and the circuit traversing tank 100 (the storage circuit). The solar circuit comprises pump 145, collector 160, coil 135 and interconnecting pipes. The storage circuit comprises pump 115, tank 100 and storage tank 130. The fluid in the solar circuit is a brine whose freezing point is lower than the lowest outdoor night temperatures expected. The fluid in the storage circuit is water, through the same brine as is used in the solar circuit could be substituted.

Figure 6:
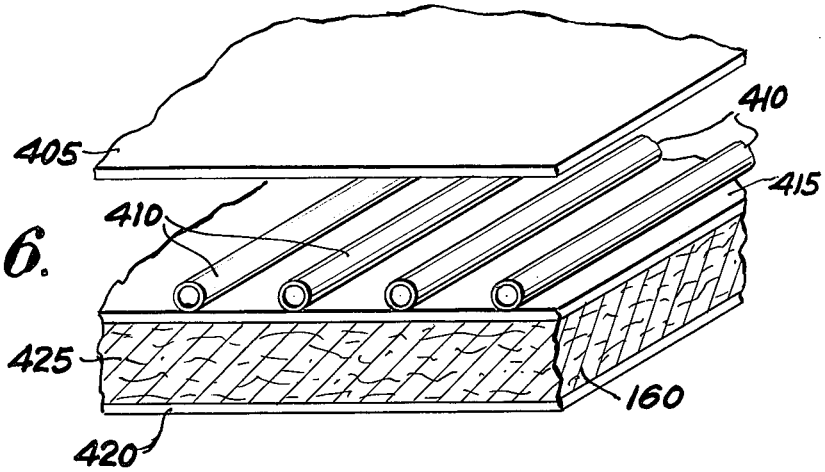
FIG. 6 is a cutaway view of a typical solar collector.

Solar collector 160 is constructed in principle according to the detail shown in FIG. 6. Brine flow tubes 410 are attached to a blackened plate 415. This plate which is warmed by the incident solar radiation is thermally insulated from its mounting plate 420 by thermal insulation 160. The incident thermal radiation is allowed to reach plate 415 with its attached heat transfer tubes 410 through a spaced transparent pane of plastic or glass. In mild climates only one cover pane is required. The number of cover panes which are efficiently usable depends on the greatest temperature difference between the tubes 410 and the air on the upper side of the outer cover panes 400. Under daytime conditions, when solar radiation is able to reach collector 160 and impinge on and traverse cover panes 400 and 405, the energy is collected in and serves to warm plate 415 and tubes 410. This heat, in turn, is transferred to the brine in the solar circuit which is pumped through the tubes 410. The brine to be circulated through solar heater 160 is withdrawn by pump 145 via conduit 140 from heat transfer coil 135. This coil 135 is immersed in the brine 170 contained in the storage tank 130. The pump 145 discharges the brine at higher pressure through conduit 155 into solar collector 160, constructed as described above according to FIG. 6. In the solar collector the brine is warmed. This warm brine is delivered to heat transfer coil 135, immersed in tank 130, where it delivers up a substantial portion of the heat to the brine 170 of the tank circuit, warming it. The effect of the brine giving up its heat is to warm the brine 170 stored in tank 130, raising its temperature so that brine 170 can function as a heat storage medium. By the use of heat storage, heat can be supplied to service exchanger 100 even during periods when the incident solar radiation reaching collector 160 is zero.

The motor 150 is the solar circuit is controlled by thermostat 163 whose bulb 161 is located in a position to sense the incidence of solar radiation. This bulb is positioned within solar collector 160. When sufficient solar radiation impinges on bulb 161 to raise its temperature above its predetermined setting, switch 163 closes, allowing electrical energy to be delivered to motor 150, which, in turn, drives pump 145, circulating the brine in the solar circuit as above described for the purpose of heating the water in tank 130. Though not shown in the drawing, motor 150 is also controlled by other thermostats sensing the temperature of water 170 in tank 130. A first such thermostat causes motor 150 to stop when the temperature of the water 170 in the tank had been raised to a sufficiently high temperature, for instance, 150° to 180° F.

A differential temperature thermostat having bulbs both in tank 130 and in solar collector 160 is employed so that pump 150 can not start until the temperature of the collector 160 is higher than the temperature of the water 170 in the tank. The operation of motor 150 is independent of the operation of compressor 2 and of the condition of four-way valve 10 since it is entirely likely that under certain seasonal conditions it will be desired to store heat in tank 130 when the compressor is off. The controls may even be arranged in such a way that if sequential cycles of heating and cooling are required, as in spring or fall, when there may be warm, summer days and cool summer evenings, the heat rejected by compressor 6 during the cooling cycle be circulated and dissipated at tank 100 and used to warm the water 170 in that tank so that it can be drawn on and used for heating on the next alternate heating cycle.

The operation of the storage circuit including motor 120 which drives pump 115 for the purpose of circulating water through the circuit is as follows:

When compressor motor 2 is energized, and at the same time valve 10 is in the heating mode, causing compressor discharge vapor to be delivered to conditioning coil 74, thermostat switch 173 will sense the temperature of water 170, stored in tank 130, and if this temperature is above its setting, for example, 60° F, will cause three-way valves 16 and 28 to be energized so that low pressure cold liquid refrigerant leaving thermal expansion valve 42 will traverse three-way valve 28 and be directed via conduit 26 into heat transfer coil 24 located in tank 100. There, the liquid refrigerant will be boiled to vapor, which will be conveyed to the compressor by way of conduit 22, three-way valve 16 and conduit 14. Thermostat 173, which causes three-way valve 16 and 18 to be energized during this period, also cause motor 120, which drives pump 115 to be energized, causing circulation of water 170 through tank 100 in a heat transfer relationship with coil 24, imparting its stored heat to the evaporating refrigerant in coil 124. The action of the heat pump system in this mode is to cool the water traversing tank 100 and in turn lower the overall temperature of the water stored in tank 130. When the temperature of that water reaches a predetermined minimum, in this case approximately 58° F, thermostat 173 will open, causing 120 to stop operating and causing coil 18 and coil 30 of three-way valves 16 and 28 respectively to become deenergized, directing the flow of cold refrigerant liquid from expansion valve 42 through outdoor coil 34. During this mode fan 38 is caused to operate, forcing ambient air over the finned heat transfer coil 34, causing that outdoor air to be further cooled and to deliver up its heat to evaporating refrigerant. The resulting refrigerant vapor is delivered via conduit 20 and three-way valve 16 to suction line 14 and the compressor, as earlier described. It can readily be seen that this system is highly adaptable to relatively small, maintenance-free, home conditioning systems, as well as larger heat pump systems, for commercial or industrial application. By eliminating the use of a cooling tower and allowing the solar and tank circuits to be completely closed, these wet portions of the refrigeration cycle can be made almost completely maintenance-free as distinct from the high maintenance costs which are routinely generated by the use of cooling towers where the passage of ambient air through circulated falling water cools the water but also serves to cause the maintenance of high acidity in the water and the collection of ambient air-borne dirt in the water, as well as the concentration of solutes, which concentration, if allowed to continue unabated, will result in the precipitation of solids in the heat exchangers and pipes, causing their eventual malfunctioning and non-operation. By contrast, in the brine and water side of this invention, there is no evaporation, no accumulation of solutes, and the circulating fluid in a sense may need never be lost or replaced and can be treated with the necessary corrosion inhibitors to ensure maximum life of all the immersed equipment.

Figure 2:
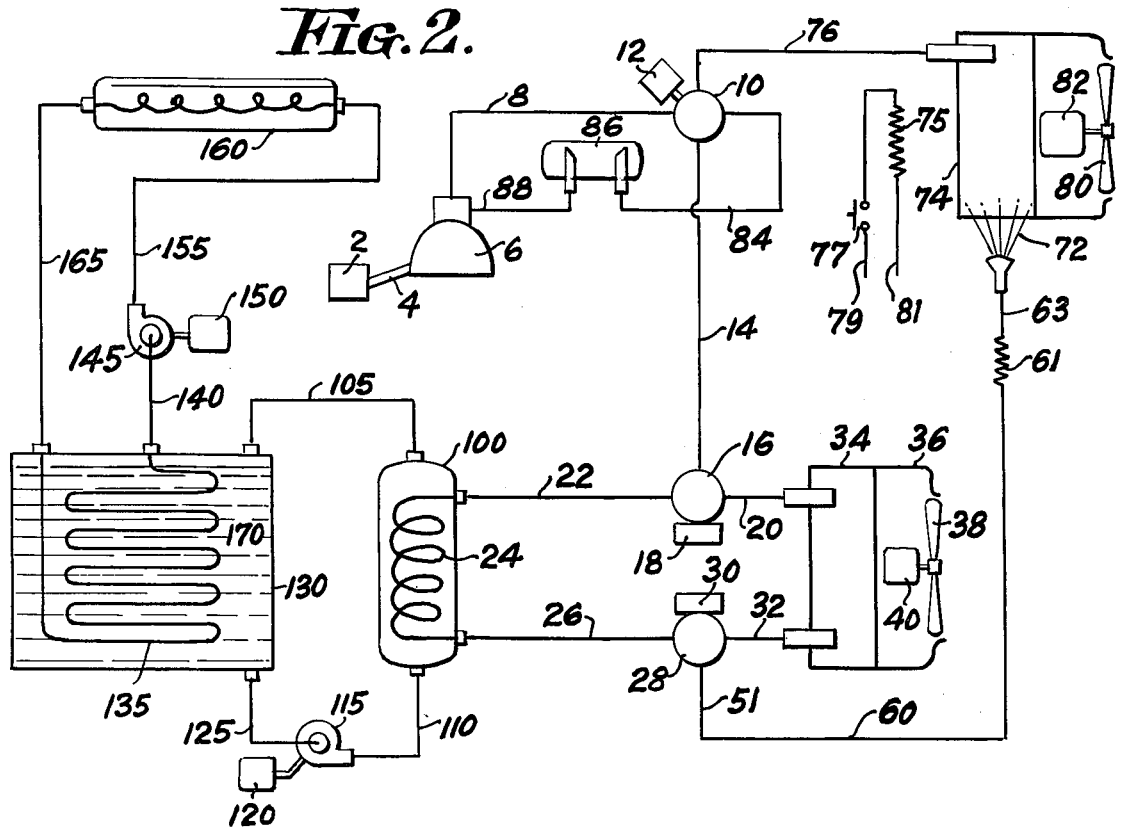
FIG. 2 is similar to FIG. 1 with the exception that thermostatic expansion valves are replaced by a single capillary tube and the high side liquid receiver is replaced by a low side suction accumulator.

The solar collecting and storage of FIG. 2 is identical to that of FIG. 1. However, the refrigeration cycle has been modified by the elimination of the receiver 52, thermal expansion valves 42 and 62 and their associated check valves 46 and 68, and substituted therefor is the traditional restrictor, of which one manifestation shown in the drawing as No. 61 is a properly selected capillary tube. Because in reversible capillary tube systems more charge is generally required for summer operation than for winter operation, a low side receiver 86 is supplied in the suction line 84 between four-way valve 10 and the compressor inlet. The operation of the refrigeration cycle in FIG. 2 is as follows:

On the cooling mode, coil 12 of four-way valve 10 is energized. The compressor discharges its vapor in discharge line 8, which is directed by the four-way valve 10 into discharge line 14 and by deenergized three-way valve 16 into outdoor condensing coil 34. This coil abstracts the latent heat of vaporization from the refrigerant vapor, condensing it to a liquid and delivers the cooled liquid to the outlet conduit 32 and three-way valve 28, which in its deenergized condition transmits the liquid into liquid line 60, which conveys it to capillary tube 61. In capillary tube 61 the pressure of the refrigerant is reduced from the condensing pressure found in condenser 34 to the evaporating pressure found in evaporator 74. Within the evaporator the refrigerant is boiled away and, in so doing, cools the air stream traversing it, said air stream having been generated by the operation of fan 80, which, in turn, is driven by motor 82. The suction vapor returns through suction line 76 and is directed by four-way valve 10 into suction conduit 84, through which it traverses suction accumulator 86 before reaching the compressor.

During the heating mode, the coil 12 of the four-way valve is deenergized. The discharge vapor is directed by the deenergized valve 10 from discharge line 8 into conduit 76 and directed thereby into indoor coil 74 where the hot refrigerant vapor condenses, giving up its latent heat of vaporization and thereby warming the air stream traversing the coil. The resulting liquid is delivered to the capillary tube 61 by the distributing assembly 72. The capillary tube reduces the pressure to a level sufficiently low for evaporation to take place. If the controls as described under FIG. 1 call for heat to be abstracted from the water coil 24, then both three-way valves 28 and 16 are energized, causing the low pressure cold refrigerant to traverse water coil 24 and abstract the heat from the water 170, which has been pumped through, around and over that coil located within tank 100 (Mode 1). Should the heat stored in fluid 170 have been exhausted, or under other conditions, should the outside ambient be in the region of 40° or 50°, where indoor heating is still required or more than enough heat is available from the outdoor air, then both three-way valves 28 and 16 will be deenergized, causing the cold refrigerant to traverse the outside finned heat exchanger 34. In this Mode 2, when adequate sunlight is available, pump 150 will be caused to run to circulate its warm brine through coil 135 immersed in the heat hold fluid 170. In this way, the system can simultaneously provide heat to the interior of the residence without depleting, and in fact, while augmenting, the heat stored in fluid 170 during daylight hours so that this fluid will be at the highest possible temperature level and therefore have the greatest possible amount of heat stored in it in preparation for the potentially long cold night ahead.

Under other circumstances, it the rare case arises, that there are persistent outdoor conditions of very cold, cloudy weather, the heat in storage 170 may be exhausted and the air temperature at coil 34 may be so low that insufficient heat can be abstracted to maintain comfort conditions in the house. To cope with this situation, electric resistance heater 75, which is controlled by thermostat 77 and supplied by wires 79 and 81 with electric power, can be used to supplement the heat supplied by the heat pump.

Figure 3:
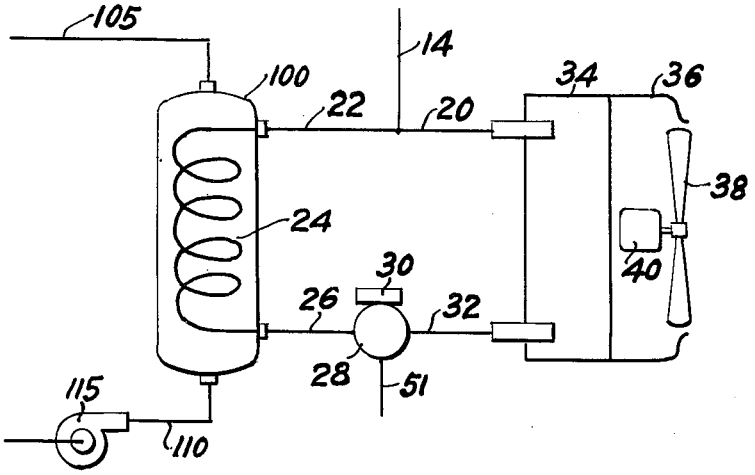
FIG. 3 shows only the service side heat exchanger of FIGS. 1 and 2 except the means for selecting the operative service exchanger is a single three-way valve.

FIG. 3 shows the service side heat exchangers, including air coil 34 and water coil 24, which are intended to be used with the refrigeration circuit of either FIG. 1 or FIG. 2, connection thereto being made by way of conduit 14 and conduit 51. In this modification only one three-way valve is used. During heating, cold liquid refrigerant supplied either by expansion valve 42 or capillary tube 61 is delivered to conduit 51 in FIG. 3. If coil 30 of valve 28 is deenergized, it will direct the cold refrigerant to conduit 32 and thence to finned coil 34, where it will further cool the outdoor air extracting heat therefrom, and the resulting vapor will be delivered to suction line 14, as in FIGS. 1 or 2. Should it be desirable and necessary to withdraw heat from the storage medium, then solenoid coil 30 will be energized and three-way valve 28 will direct cold liquid refrigerant into conduit 26 and then into heat transfer coil 24 for the purpose of abstracting heat from the warm water flowing around water coil 24.

During the cooling cycle, discharge vapor will be delivered to conduit 14 by the four-way valve 10 in either FIG. 1 or FIG. 2. In FIG. 3 the vapor will traverse both conduit 20 and 22. If coil 30 is deenergized, then conduit 26 will be closed. Refrigerant vapor entering coil 24 will condense therein and gradually fill it completely to the point where its inner surface is completely filled with liquid refrigerant so that no further condensing can occur. At that time no further flow from discharge line 14 will occur into branch 22, but instead 100% of the flow of discharge vapor of the compressor will be directed into branch 20, whereby condensing will be achieved through the use of outdoor coil 34. Should, under other circumstances, it be desired to discharge heat in water coil 24, then the coil 30 of the three-way valve will be energized, causing conduit 32 of the outdoor coil to be dead-ended, or closed. Immediately, liquid refrigerant accumulated in water coil 24 will flow through conduit 26, which has now been opened to conduit 51. This liquid will be rapidly metered through the expansion device of FIG. 1 or 2, evaporated in the indoor coil and recycled to the compressor. In the meantime, vapor flow will occur through branches 20 and 22. Since the outlet conduit of coil 34 has been closed, coil 34 will now fill with liquid refrigerant and thereby become operative, allowing the full discharge stream to traverse water coil 24 and liberate its heat of condensation therein.

Figure 4:
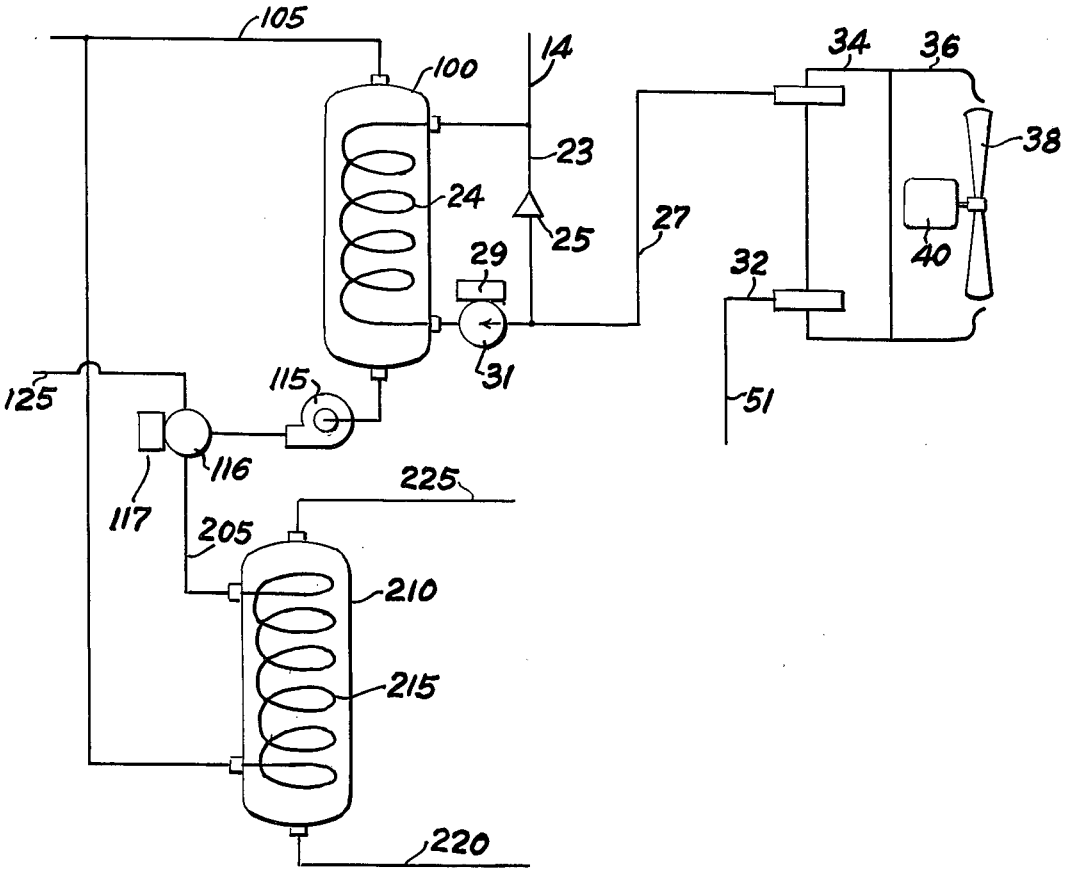
FIG. 4 is like FIG. 3 except the two service exchangers are connected in series so that no selection process is required, and the second (refrigerant-brine) service heat exchanger is connected through transfer pipes to a heat exchanger for a domestic hot water system.

FIG. 4 uses the same service side heat exchangers 24 and 34 as FIGS. 1, 2 and 3. However, instead of being connected in parallel, in FIG. 4 the two heat exchangers are connected in series with a valved bypass around the water coil to avoid its freezing up under certain circumstances to be explained. During the cooling cycle, the four-way valve 10 directs discharge vapor into discharge line 14. The vapor must traverse water coil 24 and is prevented from bypassing the water coil through bypass conduit 23 by check valve 25 located in that conduit. If it is desired to utilize some or all of the heat in the discharge vapor, circulating pump 115 will operate, bringing cool water into shell 100 and into heat exchange contact with water coil 24, causing partial condensation of the vapors. The mixture of refrigerant liquid and vapor will traverse solenoid valve 31 in its backward direction. It is a characteristic of all solenoid type valves that they will allow and prevent flow in the forward direction only but cannot prevent flow in the reverse direction, whether the coil is energized or deenergized. Valve 31 is installed to allow and prevent flow to the coil 24. Therefore it cannot prevent flow from the coil 24 and the mixture of refrigerant liquid and vapor thereupon traverses conduit 27 to the inlet of finned coil 34, where any remaining vapor condenses to a liquid and the fully condensed liquid refrigerant leaves coil 34 by way of its outlet conduit 32, communicating with conduit 51, which in FIG. 1 would connect to the expansion valve 42 and check valve 46 subassembly and in FIG. 2 would communicate with liquid line 60 for transfer and conveyance to capillary tube 61. A single three-way solenoid valve can be substituted for the valves 25 and 31.

If, for any reason, the operator or control system did not require heat to be withdrawn from the discharge stream in heat exchanger 24, the gas would pass through coil 24 without condensing and would enter coil 34 in the same condition that it would have if coil 24 had not been present. Thereupon coil 34 would perform its normal, full condensing job and deliver the resulting liquid to its outlet conduit 32 and thence through conduit 51 to the expansion device.

On heating cycle, the expansion device would deliver all of the low pressure cold liquid first to the finned coil 34. If all the liquid evaporated in coil 34 because the air traversing it was warm enough to achieve that function, then only vapor would traverse the communicating line 27. Valve 31 is actuated by thermostat 173, described under FIG. 1. In FIG. 1 this thermostat serves to actuate and control the two three-way solenoid valves. In this FIG. 4 thermostat 173 serves to deenergize and close solenoid 31 whenever the water 170 has reached sufficiently low temperature that if it were cooled further it would freeze; that is, all of the available heat has been abstracted from it. Under normal conditions, when there is adequate heat in water 170, thermostat 173 will cause solenoid valve 31 to be opened, allowing free flow of all effluent from coil 34 into the water coil 24. So long as solenoid valve 31 is open, check valve 25 will remain closed by virtue of its spring load and there will be full flow through coil 24. If the air traversing coil 34 is warm, the effluent will be all vapor and therefore relatively little, if any, cooling of the circulating water 170 will occur since the heat pump will be abstracting as much heat from its environment as it is capable. If, however, the air temperature at heat exchanger 34 drops and the amount of heat which the coil can absorb is not sufficient to evaporate all the liquid refrigerant, there will be a mixture of refrigerant liquid and vapor traversing conduit 27 and entering coil 24. Now the warm liquid 170 circulating through tank 100 in contact with heat exchanger 24 will evaporate to dryness any remaining liquid and transmit vapor only through suction line 14 back to the compressor. If the outdoor temperature drops to a very low level, almost no heat will be absorbed by heat exchanger 34 and the percentage of liquid refrigerant in the mixture entering coil 24 will be very high. Should the system continue to operate, drawing heat from circulating fluid 170 until the temperature of that fluid approaches 32° and danger of freezing arises, thermostat 173 will cause solenoid 31 to close, forcing the refrigerant vapor mixture to return directly to the compressor via bypass 23 and spring-loaded check valve 25, which now will push open.

During cooling conditions, when heat is rejected at one or both of the heat exchangers 24 and 34, the designer may find it desirable to utilize some of the heat that would ordinarily be wasted for heating domestic hot water or some other heating purpose. To achieve this, a second heat exchanger shell 210 with internal coil 215 is so connected that the hot water leaving shell 100 instead of returning to the heat storage tank 130 can be diverted instead to heat exchanger 215, which can act as a main heater or as a preheater for domestic hot water which would be supplied to it cold through pipe 220 and warmed within the shell 210 and finally carried away in a hot state through discharge pipe 225. In this arrangement, the fan motor 40 for heat exchanger 34 would have to be controlled by a thermostat, not shown, which senses the temperature of the water 170, circulating it through heat exchanger 100, or alternately, by a pressure switch sensing the pressure of the refrigerant in its own coils. If either the temperature of the water 170 or the pressure of the refrigerant exceeded a preset value, then fan motor 40 would be energized to turn on fan 38 for the purpose of drawing outside cooling air over finned coil 34 for the purpose of completing the condensing operation.

Figure 5:
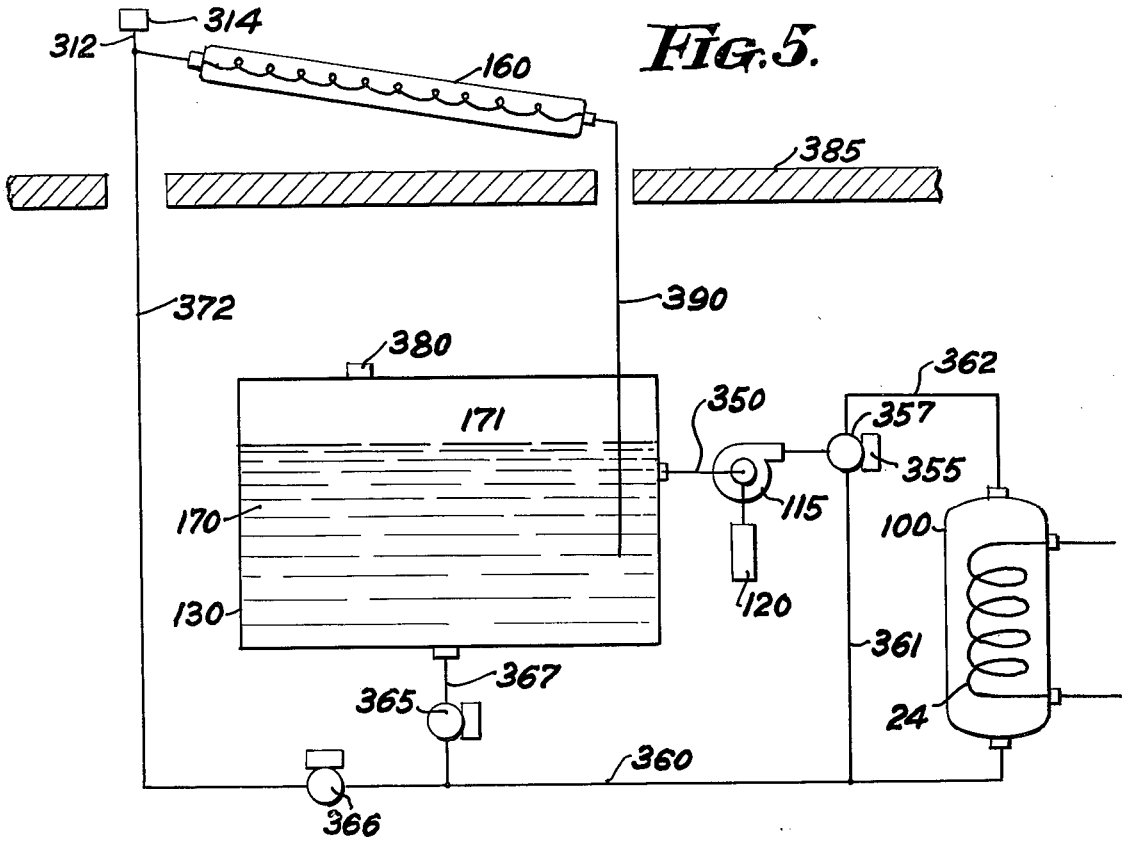
FIG. 5 shows the refrigerant brine-service heat exchanger of FIGS. 1, 2, 3 and 4, including a heat storage tank, but with a single pump, including three solenoid valves arranged so that the flow path of the brine can be varied; first, through the solar collector, the storage tank and the service heat exchanger in sequence when solar energy is available and heat is needed; second, through the storage tank and the service heat exchanger only in sequence, bypassing the solar collector, for withdrawing heat from the heat storage when incident solar energy is not available, without causing the brine to traverse the solar collector

FIG. 5 shows the solar heat storage and water coil portion of the system but modified so that only one pump is necessary. During days when there is high intensity of solar energy, pump 115, driven by motor 120, withdraws brine 170 from tank 130, and circulates it to collector 160 by way of three-way valve 357, which diverts flow into conduit 361 and, in turn, 360, solenoid valve 366, which is open and then to the inlet of solar collector 160. The top of the vertical line 372 is vented by means of air vent 314. The brine, heated by solar collector 160, is then delivered through conduit 390 to the tank. Should the operator or the system design require, during the period of solar collection, that heated brine be delivered to tank 100 for the purpose of supplying heat to heat exchange coil 24, three-way valve 357 will shift, closing off flow to conduit 361 and instead, providing flow to conduit 362, which delivers it to the inlet of tank 100. Under cloudy or night conditions, when it is desired to draw on the heat stored in brine 170, three-way valve 357 will divert flow from the pump 115 into conduit 362 and close conduit 361. At the same time, solenoid valve 366 will be closed. Solenoid valve 365 will be open. In this way no flow through conduit 172 and solar collector 160 can occur. Under night conditions, flow through the solar collector would be harmful, since there would be a net loss of heat by conduction and radiant heat transfer out of the collector. Instead, the flow path will be through the tank 130, the pump 115, heat exchanger tank 100 and then back to tank 130.

FIG. 6 shows a detailed cutaway view of a typical solar collector. The collector comprises tubes for the flow of brine or water 410, which are fastened to or soldered to a metal backing plate 415. This plate is mounted on insulation 425, which has its own backer 420. Over the tubes and separated from them but parallel to the backing plate 415 is a cover pane 405 which can be made of clear plastic or glass. This pane allows the entry of radiant heat from the sun, but prevents the circulation and loss of warmed air from the space between backing plate 415 and the pane. Because of the large surface areas involved, heat loss through the transparent pane is potentially the cause of a serious loss of efficiency. This invention makes it unnecessary, except in the most severe climates, to add a second pane to the collector because the system of this invention allows the circulating fluid to be completely effective, though heated to a temperature much lower than that necessary to perform successful heating with other types of solar collector systems. For instance, in a standard solar collector system, where the heated fluid is piped directly into the residence, the fluid must be heated to a temperature well over 100°. In the system of my invention, however, because I abstract the heat from the fluid employing a heat pump, which has its maximum efficiency when operating in a temperature range from about 40° to about 80°, the fluid can satisfactorily circulate and be heated to a temperature no higher than about 80°. As a result of the system's capability of employing the fluid while circulating it at a relatively low temperature, it is possible to employ simpler collectors and yet achieve relatively great heat collection efficiency even under adverse and cold outdoor ambient conditions. While typical embodiments of the present invention have been shown in the drawing and described above, it will be apparent that the invention is capable of many modifications and changes without departing from the spirit and the principle of the invention. In view thereof it should be understood that the forms of the invention specifically disclosed herein are intended to be illustrative only and are not intended to limit the scope of the invention.

I claim:

1. An improved reversible refrigeration system including conduit connected compressor and reversing means, said reversing means having a conditioning side and a service side; at least one conditioning heat transfer means subject to the conditioning side of the reversing means and positioned to affect a conditioned space; wherein the improvement comprises; first service heat transfer means subject to the service side of the reversing means and adapted to transfer heat between refrigerant and a liquid; second service heat transfer means subject to the service side of the reversing means and adapted to transfer heat between refrigerant and air; and control means adapted to apportion the heat transferred on the service side between said first and said second service heat transfer means.

2. An improved system as in claim 1 where the control means is a valve.

3. An improved system as in claim 2 including a first conduit connected to said first service heat transfer means; a second conduit connected to said second service heat transfer means; where the valve alternately connects the first conduit and the second conduit to a third conduit.

4. An improved system as in claim 1 where the first and second service heat transfer means are series connected in the refrigerant flow stream.

5. An improved system as in claim 1 including solar heat collector means adapted to supply heat to the liquid.

6. An improved system as in claim 5 including liquid heat storage means adapted to receive heat from the solar collector to store said heat and to deliver the heat to the first service heat transfer means.

7. An improved system as in claim 1 including a third service heat transfer means adapted to receive heat from the first service heat exchange means.

8. An improved reversible refrigeration system comprising a compressor having a discharge connection and suction connection; a four-port reversing valve having an inlet port, an outlet port, a conditioning port and a service port; a suction conduit communicating between the outlet port and the suction connection; a discharge conduit communicating between the inlet port and the discharge connection; a conditioning heat exchanger, conduit connected to the conditioning port; at least one pressure reducing device; a first service heat exchanger adapted to transfer heat between refrigerant and liquid; a second service heat exchanger adapted to transfer heat between refrigerant and air; and conduits connecting the service heat exchangers between the pressure reducing device and the service port and means for apportioning the total heat transferred on the service side between said first and said second service heat exchangers.

9. A system as in claim 8 where the service heat exchangers are parallel-connected and include valve means for directing flow alternately through the first service heat exchanger and the second service heat exchanger.

10. A system as in claim 8 where the service heat exchangers are series connected.

11. A system as in claim 8 which includes solar collector means having a liquid flow passage adapted to receive solar radiation and to warm liquid flowing therethrough; heat storage means adapted to receive heat absorbed in the collector, hold it and deliver it; pump means; and conduit means operatively interconnecting the collector, heat storage, pump means and first service heat exchanger to secure heat transfer from the solar collector to said first service heat exchanger.

12. A system as in claim 11 which includes a heat transfer coil in the heat storage means and a second liquid; said liquid having a freezing point lower than the freezing point of water; and second pump means adapted to circulate the second liquid between the heat transfer coil in the heat storage means and the solar collector.

13. A system as in claim 11 which includes a third service heat exchanger means and conduits connecting said third heat exchanger mean with said first service heat exchanger and means for alternately conveying heat transferred in said first service heat exchanger to said third service heat exchanger and to said heat storage.

* * * * *